US011501914B2

(12) United States Patent
Lin et al.

(10) Patent No.: US 11,501,914 B2
(45) Date of Patent: Nov. 15, 2022

(54) GRAIN BOUNDARY DIFFUSION METHOD OF R-FE-B SERIES RARE EARTH SINTERED MAGNET

(71) Applicant: Fujian Changting Golden Dragon Rare-Earth Co., Ltd., Fujian Province (CN)

(72) Inventors: Yulin Lin, Fujian (CN); Hiroshi Nagata, Fujian (CN); Zongbo Liao, Fujian (CN); Juhua Xie, Fujian (CN); Hanshen Ye, Fujian (CN)

(73) Assignee: Fujian Changting Golden Dragon Rare-Earth Co., Ltd, Fujian Province (CN)

( * ) Notice: Subject to any disclaimer, the term of this patent is extended or adjusted under 35 U.S.C. 154(b) by 286 days.

(21) Appl. No.: 16/092,292

(22) PCT Filed: Sep. 21, 2017

(86) PCT No.: PCT/CN2017/102605
§ 371 (c)(1),
(2) Date: Oct. 9, 2018

(87) PCT Pub. No.: WO2018/054314
PCT Pub. Date: Mar. 29, 2018

(65) Prior Publication Data

US 2020/0027656 A1 Jan. 23, 2020

(30) Foreign Application Priority Data

Sep. 26, 2016 (CN) ..... 201610850051.2

(51) Int. Cl.
*H01F 41/02* (2006.01)
*H01F 1/057* (2006.01)

(52) U.S. Cl.
CPC ..... *H01F 41/0293* (2013.01); *H01F 1/0575* (2013.01)

(58) Field of Classification Search
CPC .. H01F 1/0575; H01F 1/0577; H01F 41/0293; H01F 1/16; H01F 1/18;
(Continued)

(56) References Cited

U.S. PATENT DOCUMENTS

2009/0252865 A1* 10/2009 Sagawa ..... H01F 41/005 427/127
2011/0189498 A1 8/2011 Nagata et al.
(Continued)

FOREIGN PATENT DOCUMENTS

CN 1806299 A 7/2006
CN 101842862 A 9/2010
(Continued)

OTHER PUBLICATIONS

Translated Chinese Office Action directed towards the Chinese application of the current US application, retrieved from EPO website (Espacenet.com) om Oct. 21, 2020. (Year: 2020).*
(Continued)

*Primary Examiner* — Peter Dungba Vo
*Assistant Examiner* — Joshua D Anderson
(74) *Attorney, Agent, or Firm* — Cooper Legal Group, LLC

(57) ABSTRACT

The present invention discloses a grain boundary diffusion method of an R—Fe—B series rare earth sintered magnet, an HRE diffusion source, and a preparation method thereof, comprising the following steps: engineering A of forming a dry layer on a high-temperature-resistant carrier, the dry layer being adhered with HRE compound powder, the HRE being at least one of Dy, Tb, Gd, or Ho; and engineering B of performing heat treatment on the R—Fe—B series rare
(Continued)

earth sintered magnet and the high-temperature-resistant carrier treated with the engineering A in a vacuum or inert atmosphere and supplying HRE to a surface of the R—Fe—B series rare earth sintered magnet. The method can reduce the consumption of heavy rare earth element and control the loss of residual magnetism Br while increasing the coercivity.

18 Claims, 5 Drawing Sheets

(58) Field of Classification Search
CPC ..... H01F 1/22; H01F 1/32; Y10T 29/49075; Y10T 29/49076
See application file for complete search history.

(56) References Cited

U.S. PATENT DOCUMENTS

| | | | | |
|---|---|---|---|---|
| 2012/0176211 | A1* | 7/2012 | Sagawa ..... | B22D 11/001 335/302 |
| 2020/0027656 | A1 | 1/2020 | Lin et al. | |
| 2020/0161047 | A1* | 5/2020 | Zhou ..... | C23C 30/00 |

FOREIGN PATENT DOCUMENTS

| | | | |
|---|---|---|---|
| CN | 103985534 | A | 8/2014 |
| CN | 103985535 | A | 8/2014 |
| CN | 104299744 | A | 1/2015 |
| JP | 2012169436 | A | 9/2012 |
| JP | 2012217270 | A | 11/2012 |
| WO | 2013061836 | A1 | 4/2015 |

OTHER PUBLICATIONS

Translated International Search Report directed towards the International application of the current US application, retrieved from EPO website (Espacenet.com) om Oct. 21, 2020. (Year: 2020).*

Machine translation of JP 2012-169436 provided by EPO website (Espacenet.com) (Year: 2012).*

International Search Report in corresponding international application No. PCT/CN2017/102605 dated Dec. 6, 2017, 4 pgs.

* cited by examiner

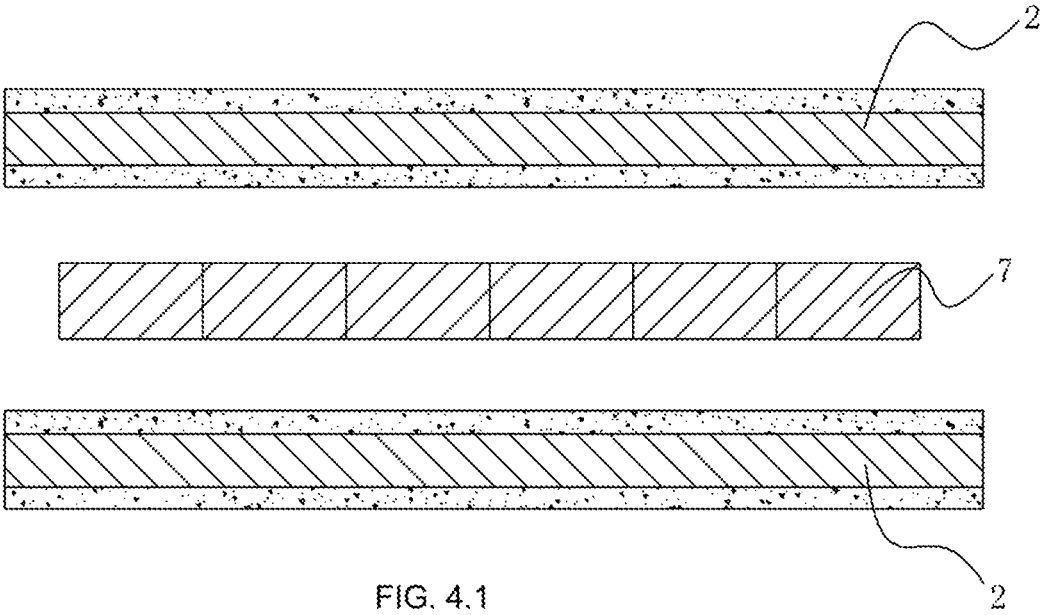
FIG. 4.1
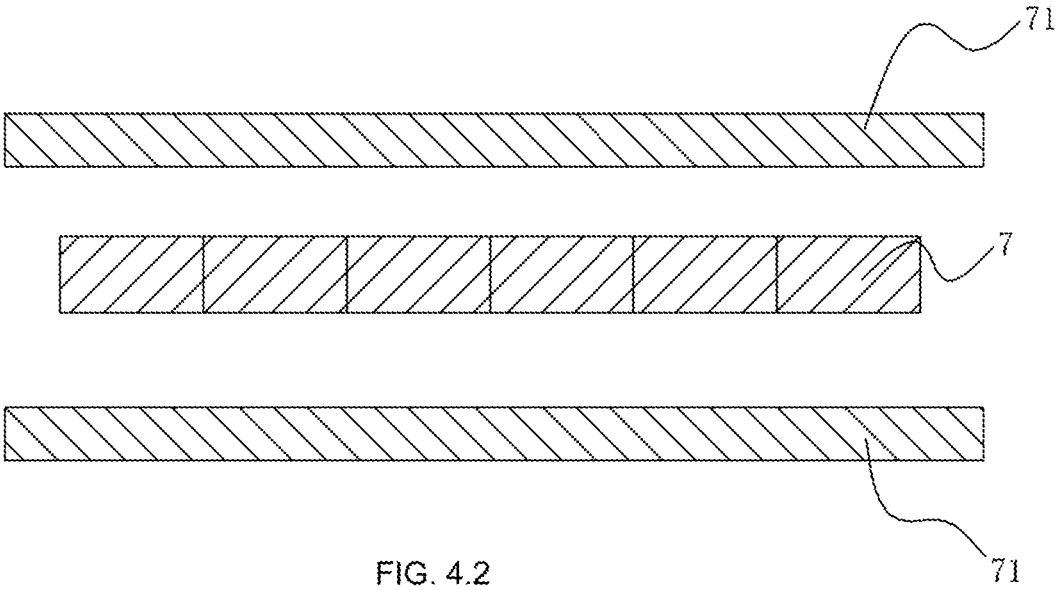
FIG. 4.2

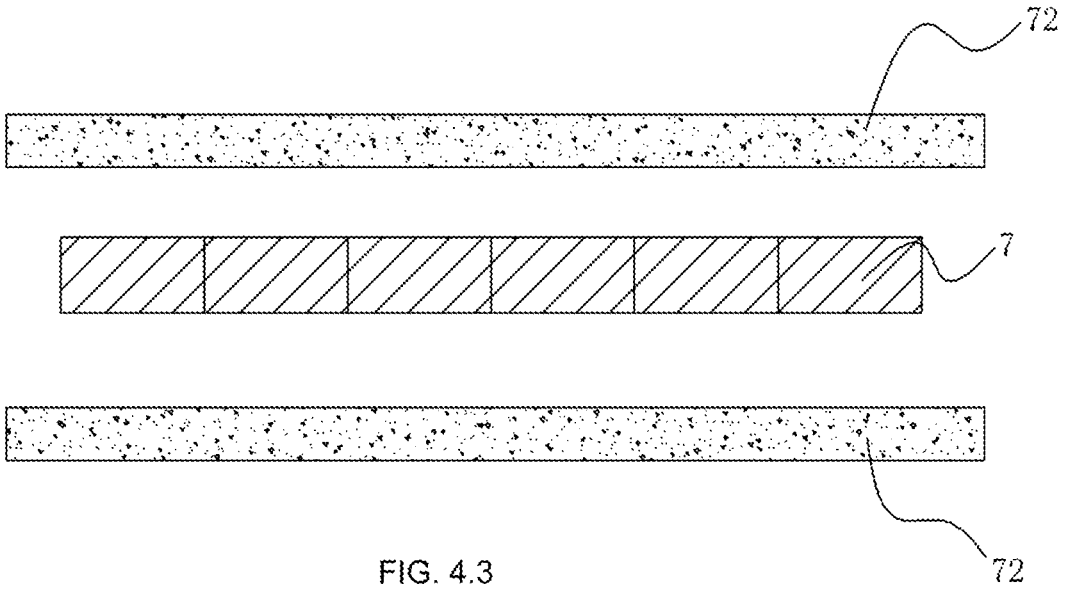
FIG. 4.3
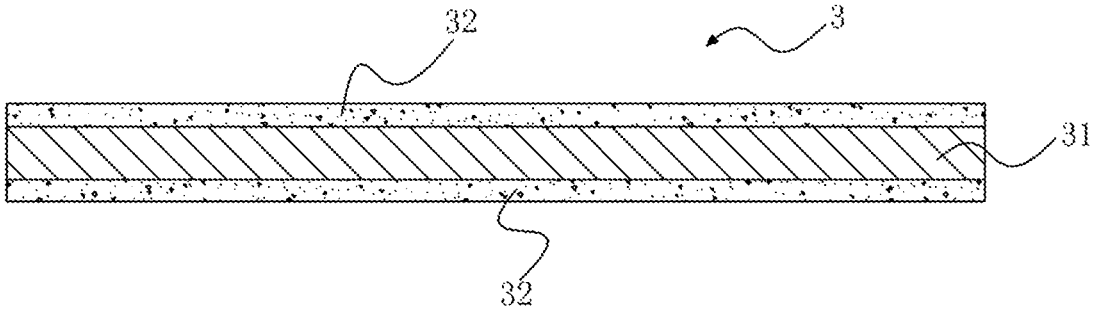
FIG. 5
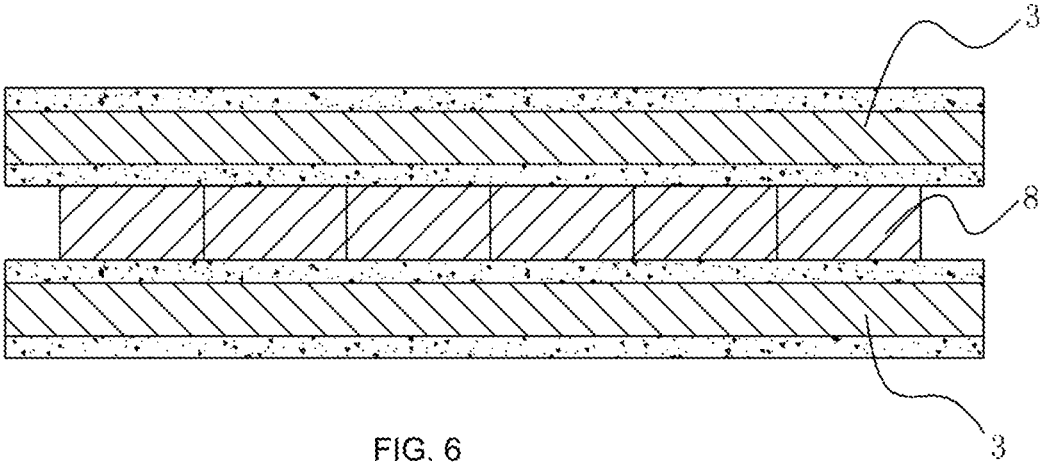
FIG. 6

GRAIN BOUNDARY DIFFUSION METHOD OF R-FE-B SERIES RARE EARTH SINTERED MAGNET

TECHNICAL FIELD

The present invention relates to the technical field of magnet manufacturing, in particular to a grain boundary diffusion method of R—Fe—B series rare earth sintered magnet, an HRE diffusion source, and a preparation method thereof.

BACKGROUND

Coercivity (Hcj), which improves the demagnetization resistance of magnets, is the most important technical parameter of rare earth sintered magnets (such as Nd—Fe—B sintered magnets). In traditional methods, the coercivity of Nd—Fe—B sintered magnets is improved mainly through the following methods: 1) adding heavy rare earth elements (hereafter referred to as HRE, HREE, Heavy Rare Earth, or Heavy Rare Earth Elements) in the manufacturing process of Nd—Fe—B sintered magnets; 2) adding trace elements to optimize the grain boundary structure and refine particles, but this method increases the non-magnetic phase content in the magnets and decreases Br; and 3) performing HRE grain boundary diffusion treatment on Nd—Fe—B sintered magnets. In both method 1) and method 3), HRE is used to partially replace or fully replace Nd in $Nd_2Fe_{14}B$ grains to increase the coercivity. Of the two methods, method 3) is better for efficiency and economy.

In method 1), during sintering, HRE (including Tb, Dy, or the like) diffuses into grain boundaries and enters $Nd_2Fe_{14}B$ grains to a depth of about 1-2 μm, and the coercivity increases. Because the anisotropic fields of $Dy_2Fe_{14}B$, $Tb_2Fe_{14}B$, and the like are smaller than the anisotropic field of $Nd_2Fe_{14}B$, the residual magnetism of the sintered magnets drops to a greater extent.

In method 3), a machined magnet is heated so that the Nd-rich phase of the grain boundary forms a liquid phase; heavy rare earth elements such as Dy and Tb seep from the surface of the magnet to perform grain boundary diffusion; the grains in the surface area of the magnet form a core-shell structure, and the coercivity increases. As HRE (including Dy, Tb, or the like) only enters the grains to a depth of about 5 nm, the drop of the residual magnetism of the magnet can be controlled to a certain limit (around 0.3 kGs).

However, because both method 1) and method 3) use HRE to replace Nd in $Nd_2Fe_{14}B$ grains, the saturated magnetic polarization intensity of the compound is reduced. As long as the method described above is used to increase the coercivity, the loss of the residual magnetism is inevitable.

SUMMARY

The purpose of the present invention is to overcome the deficiency in the prior art and provide a grain boundary diffusion method of a rare earth sintered magnet. The method can reduce the consumption of heavy rare earth elements and control the loss of the residual magnetism Br when the coercivity is increased.

The technical solution adopted by the present invention to solve the technical problem in the field is as follows:

A grain boundary diffusion method of an R—Fe—B series rare earth sintered magnet is provided, comprising the following steps: engineering A of forming a dry layer on a high-temperature-resistant carrier, the dry layer being adhered with HRE compound powder, the HRE being at least one of Dy, Tb, Gd, or Ho; and engineering B of performing heat treatment on the R—Fe—B series rare earth sintered magnet and the high-temperature-resistant carrier treated with the engineering A in a vacuum or inert atmosphere and supplying HRE to a surface of the R—Fe—B series rare earth sintered magnet.

In the present invention, the dry layer adhered with the HRE compound is formed on the high-temperature-resistant carrier to prepare the HRE diffusion source, which is then diffused toward the rare-earth sintered magnet. This method can reduce the surface area of HRE compound and adjust its diffusion mode and speed, thereby improving the diffusion efficiency and quality.

Further, by changing the shape of the high-temperature-resistant carrier, the present invention can obtain any arbitrary-shape of HRE diffusion source corresponding to the shape of a non-planar magnet such as an arch magnet or an annular magnet such that the diffusion distance from the HRE diffusion source to the non-planar magnet also becomes controllable. A magnet with increased Hcj (coercivity) and SQ (squareness) that does not decrease sharply is then obtained.

Another purpose of the present invention is to provide an HRE diffusion source.

An HRE diffusion source comprises the following structure: a dry layer formed on a high-temperature-resistant carrier, the dry layer being adhered with HRE compound powder, and the HRE being at least one of Dy, Tb, Gd, or Ho.

In the recommended implementation, the HRE diffusion source is a primary diffusion source. After configuring the HRE diffusion source to be a primary diffusion source, the control of the diffusion temperature and diffusion time can be adjusted to be less strict; Even when the diffusion temperature increases and diffusion time is prolonged, the consistency of the performance of magnets in different batches will not be affected.

The diffusion mode of the HRE diffusion source provided by the present invention is different from the existing mode where the rare earth sintered magnet is embedded into the HRE compound. In the process of embedding the rare earth sintered magnet into the HRE compound, the six sides of the magnet contact the HRE diffusion source, resulting in a rapid decrease in Br. The HRE diffusion source provided by the present invention can provide a uniform evaporative supply surface, stably providing atoms to the corresponding receiving surface (e.g., an orientation surface of the magnet). Such a design can control the amount of the diffused HRE compound and the diffusion position and speed to a great extent for accurate and efficient diffusion.

The diffusion mode of the HRE diffusion source provided by the present invention is also different from the mode of spraying the HRE diffusion source solution directly onto the rare earth sintered magnet. During the process of spraying the HRE diffusion source solution onto the rare earth sintered magnet, the magnet needs to be flipped. All six sides of the magnet contacting the HRE diffusion source results in a rapid decrease in Br in the diffusion process, which, at the same time, leads to the additional consumption of the HRE diffusion source on non-orientation sides. After the diffusion is done, an additional grinding process needs to be performed on the six sides. However, the HRE diffusion source provided by the present invention does not require the above process because the diffusion process is controllable and efficient.

Another purpose of the present invention is to provide a method for preparing an HRE diffusion source.

A method for preparing an HRE diffusion source comprises the following steps:

1) taking HRE compound powder, adding therein a first organic solvent until the powder is immersed, and fully grinding to obtain ground powder or ground fluid;
2) adding a film-forming agent into a second organic solvent and preparing second organic solvent solution of the film-forming agent;
3) adding the ground powder or the ground fluid into the second organic solvent solution according to a weight ratio (0.01-0.1):0.9 of the film-forming agent to the HRE compound powder, and performing uniform mixing to obtain mixed liquid; and
4) selecting a high-temperature-resistant carrier, spraying the mixed liquid onto a surface of the high-temperature-resistant carrier and performing drying.

In the recommended implementation, the first organic solvent and the second organic solvent are water and/or ethanol. Water and ethanol are environmentally friendly materials that do not cause harm to the environment.

It needs to be stated that any numerical range disclosed in the present invention includes all points in the range.

BRIEF DESCRIPTION OF THE DRAWINGS

FIG. 4.1 is a schematic view of a diffusion process in Embodiment 2;

FIG. 4.2 is a schematic view of a diffusion process in comparative example 2.1 and comparative example 2.2;

FIG. 4.3 is a schematic view of a diffusion process in comparative example 2.3 and comparative example 2.4;

FIG. 5 is a structural schematic view of a film covered Mo plate of Embodiment 3;

FIG. 6 is a schematic view of a diffusion process in Embodiment 3;

DETAILED DESCRIPTION OF THE EMBODIMENTS

Figure 1:
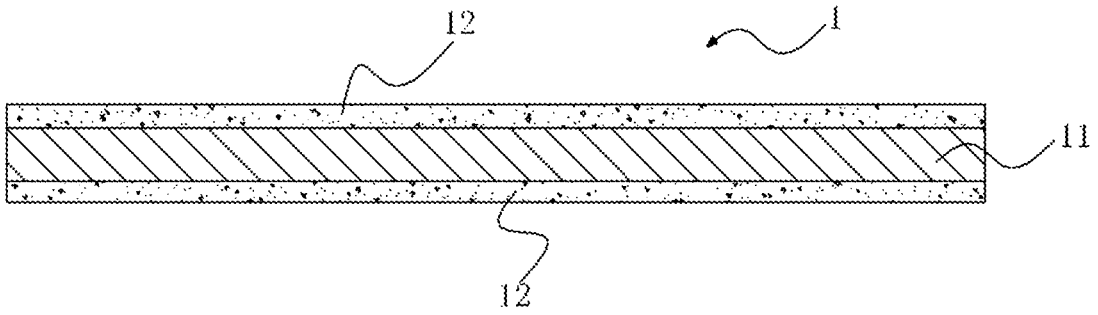
FIG. 1 is a structural schematic view of a film covered W plate of Embodiment 1.

In the recommended implementation, the R—Fe—B series rare earth sintered magnet and the dry layer on the high-temperature-resistant carrier treated with the engineering A and formed as a film are placed in a treatment chamber; and engineering B: heat treatment is performed on the R—Fe—B series rare earth sintered magnet and the dry layer on the high-temperature-resistant carrier in a vacuum or inert atmosphere and HRE is supplied from the dry layer on the high-temperature-resistant carrier to a surface of the R—Fe—B series rare earth sintered magnet.

In the recommended implementation, the atmospheric pressure of the treatment chamber is below 0.05 MPa. In the case where the diffusion atmosphere is controlled to be a vacuum environment, two diffusion modes exist: one is direct contact diffusion and the other is steam diffusion, so as to improve the diffusion efficiency.

In the recommended implementation, in the engineering B, the dry layer adhered with the HRE compound formed on the high-temperature-resistant carrier and the R—Fe—B series rare earth sintered magnet are placed in a contact manner or in a non-contact manner, and when the dry layer and the R—Fe—B series rare earth sintered magnet are placed in a non-contact manner, an average spacing therebetween is set to be below 1 cm. When placed in a contact manner, the speed that the HRE compound enters the rare earth sintered magnet is fast; but surface treatment is needed. When placed in a non-contact manner, the HRE compound is diffused in a steaming process; the speed of entering the rare earth sintered magnet is decreased and the surface treatment process can be skipped; at the same time, a steam concentration gradient is formed and high-efficiency diffusion is achieved.

In the recommended implementation, in the engineering B, when the dry layer adhered with the HRE compound and R—Fe—B series rare earth sintered magnet are placed in a non-contact manner, the atmospheric pressure of the treatment chamber is below 1000 Pa. When placed in a non-contact manner, the pressure of the treatment chamber can be reduced with the diffusion efficiency being improved. The vacuum atmosphere facilitates the formation of the stream concentration gradient and the diffusion efficiency is therefore improved.

In the recommended implementation, in the engineering B, when the dry layer adhered with the HRE compound powder and R—Fe—B series rare earth sintered magnet are placed in a non-contact manner, the atmospheric pressure of the treatment chamber is preferably below 100 Pa.

In the recommended implementation, the dry layer is a film. The film adhered with the HRE compound powder according to the present invention refers to a film in which the HRE compound powder is fixed; the film refers not simply to a continuous film but it may also be a discontinuous film. Therefore, it needs to be stated that both the continuous film and the discontinuous film should be within the scope of the present invention.

In the recommended implementation, a heat treatment temperature of the engineering B is a temperature below a sintering temperature of the R—Fe—B series rare earth sintered magnet.

In the recommended implementation, in the engineering B, the R—Fe—B series rare earth sintered magnet and high-temperature-resistant carrier treated with the engineering A are heated for 5-100 h in an environment of 800° C.-1020° C. In the above-mentioned engineering, higher diffusion temperatures can be used to reduce diffusion time, thereby reducing energy consumption.

In the recommended implementation, the dry layer is a uniformly distributed film and a thickness thereof is below 1 mm. Controlling the thickness of the dry layer prevents chapping or rupture from happening, even in the case where the film-forming agent and the HRE compound powder are poorly selected.

In the recommended implementation, at least two dry layers are formed on the high-temperature-resistant carrier, and every two adjacent dry layers are uniformly distributed on the high-temperature-resistant carrier at a spacing of below 1.5 cm.

In the recommended implementation, a binding force between the dry layer and the high-temperature-resistant carrier is level 1, level 2, level 3, or level 4. When the binding force between the high-temperature-resistant carrier and the dry layer is too low, the adhesive force of the dry layer to the high-temperature-resistant carrier is not strong, which may lead to the dry layer being slightly detached or slightly agglomerated during the heating process.

A binding force test method adopted in the present invention is as follows: eleven cutting lines at a spacing of 5 mm are cut in a direction parallel with the length-width direction of the same length-width surface of the high-temperature-resistant carrier formed with the dry layer by adopting a single-edge cutting tool with a cutting edge angle of 30° and a cutting edge thickness of 50-100 μm. During cutting, the angle between the cutter and the high-temperature-resistant carrier needs to be consistent; the force is uniformly applied. The cutting edge exactly passes through the dry layer and touches the substrate during cutting. Inspection results are as shown in Table 1.

TABLE 1

Inspection result grading table

| Grading | Description |
|---|---|
| 0 | The cutting edges are completely smooth without any detached |
| 1 | A small flaking of the dry layer at a plating layer is seen at the cutting intersections, but the cross-cut area is affected significantly not greater than 5%. |
| 2 | The dry layer is detached at the cutting edge or cutting intersection, and the percentage of the affected area is significantly greater than 5% but is significantly not greater than 15%. |
| 3 | The dry layer is partially or completely detached along the cutting edge in the form of large debris, or partially or completely detached at different positions of grids, and the percentage of the affected area is significantly greater than 15% but is significantly not greater than 35%. |
| 4 | The dry layer is completely detached along the cutting edge in the form of large debris, or some grids are partially or completely detached; and the percentage of the affected area is significantly greater than 35% but is significantly not greater than 65%. |
| 5 | Severe detachment higher than level 4 |

In the recommended implementation, the dry layer adhered with the HRE compound powder further comprises a film-forming agent capable of being removed for at least 95 wt % in the engineered B, and the film-forming agent is at least one of resins, cellulose, fluorosilicone polymers, dry oil, or water glass.

In the recommended implementation, the dry layer adhered with the HRE compound powder consists of a film-forming agent and HRE compound powder.

In the recommended implementation, the dry layer adhered with the HRE compound powder is electrostatically adsorbed HRE compound powder. In the process of electrostatic adsorption, no film forming agent and other impurities are added, so that the HRE compound can be recovered directly and reused after the diffusion is complete.

In the recommended implementation, the high-temperature-resistant carrier is at least one of high-temperature-resistant particle, high-temperature-resistant net, high-temperature-resistant plate, high-temperature-resistant strip, or high-temperature-resistant bodies in other shapes.

In the recommended implementation, the high-temperature-resistant carrier is made of a material selected from zirconia, alumina, yttrium oxide, boron nitride, silicon nitride and silicon carbide, and a metal selected from Mo, W, Nb, Ta, Ti, Hf, Zr, Ti, V, Re of group IVB, VB, VIB, and VIIB in Periodic Table or made of alloy of the above materials. The high-temperature-resistant carrier made from the above-mentioned material is not deformed at high temperature, can maintain the same diffusion distance and prevent the deformation of the rare earth sintered magnet when the above-mentioned high-temperature-resistant carrier and the rare earth sintered magnet are stacked.

In the recommended implementation, the HRE compound powder is powder of at least one of HRE oxide, HRE fluoride, HRE chloride, HRE nitrate, or HRE oxyfluoride, and a particle size of the power is below 200 micrometers.

In the recommended implementation, in the dry layer adhered with the HRE compound, the amount of HRE oxide, HRE fluoride, HRE chloride, HRE nitrate, and HRE oxyfluoride is more than 90 wt %. Increasing the amount of HRE oxides, HRE fluoride, HRE chloride, HRE nitrate and HRE oxyfluoride can appropriately increase the diffusion efficiency.

In the recommended implementation, a thickness of the R—Fe—B series rare earth sintered magnet along a magnetic orientation direction thereof is below 30 mm. The grain boundary diffusion method provided in the present invention can greatly enhance the properties of the rare earth sintered magnet with the maximum thickness of 30 mm.

In the recommended implementation, the R—Fe—B series rare earth sintered magnet takes $R_2Fe_{14}B$ crystallized grains as a main phase, wherein R is at least one selected from rare earth elements including Y and Sc, wherein an amount of Nd and/or Pr is above 50 wt % of an amount of R.

In the recommended implementation, components of the R—Fe—B series rare earth sintered magnet comprise M, and M is at least one of Co, Bi, Al, Cu, Zn, In, Si, S, P, Ti, V, Cr, Mn, Ni, Ga, Ge, Zr, Nb, Mo, Pd, Ag, Cd, Sn, Sb, Hf, Ta, or W.

In the recommended implementation, a heat treatment process is further performed on the R—Fe—B series rare earth sintered magnet after the engineering B. After the heat treatment process, the magnetic performance and consistency of the rare earth sintered magnet can be improved.

The present disclosure is further described in detail in conjunction with examples hereinafter.

Example 1

Step a: $TbF_3$ powder with an average grain size of 10 micrometers was taken; water was added therein until the $TbF_3$ powder was immersed; and the mixture was placed in a ball mill for grinding for 5 hours to obtain ground powder.

Step b: cellulose was added into water to prepare an aqueous solution of cellulose with a concentration of 1 wt %.

Step c: the ground powder obtained in step a was added into the aqueous solution obtained in step b according to a weight ratio 1:9 of cellulose to $TbF_3$ powder and mixed evenly to obtain mixed liquid.

Step d: a W plate 11 with a length and width of 10 cm×10 cm and a thickness of 0.5 mm was taken and placed into an oven for heating until the temperature reached 80° C. and then was removed from the oven; the above-mentioned mixed liquid was uniformly sprayed onto the surface of the above-mentioned W plate; and then the W plate was placed into the oven again for drying to obtain a film covered W plate, wherein the film was adhered with $TbF_3$ powder.

The operation of step d was repeated on the other side surface of the film covered W plate to obtain a film covered W plate 1 with the same film thickness on each side, as illustrated in FIG. 1.

The above-mentioned operation was repeated to obtain W plates with different film thickness (film thickness is as shown in Table 2).

After the binding force test, as shown in Table 2, in Embodiment 1.1, Embodiment 1.2, Embodiment 1.3 and Embodiment 1.4, the binding force between the film 12 and the W plate 11 is below Grade 4; and in Embodiment 1.5 and Embodiment 1.6, the binding force between the film 12 and the W plate 11 is Grade 5.

Embodiment 1.1-Embodiment 1.6

A rare earth magnet sintered body was prepared. The sintered body had the following atomic components: 14.7 of Nd, 1 of Co, 6.5 of B, 0.4 of Cu, 0.1 of Mn, 0.1 of Ga, 0.1 of Zr, 0.3 of Ti and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 15 mm×15 mm×30 mm, with the direction of 30 mm being the orientation direction of the magnetic field; and the processed magnet was subjected to sand blasting, purging, and surface cleaning. The magnet was subjected to magnet performance testing by using the NIM-10000H large rare earth permanent magnet nondestructive testing system of the National Institute of Metrology, China. The determination temperature was 20° C., and the determination results are as follows: Br: 13.45 kGs, Hcj: 19.00 kOe, (BH)max: 42.41 MGOe, SQ: 98.8%, and Hcj standard deviation value: 0.1.

Comparative Example 1.1-Comparative Example 1.5

Step a: $TbF_3$ powder with an average grain size of 10 micrometers was taken; water was added therein until the $TbF_3$ powder was immersed; and the mixture was placed in a ball mill for grinding for 5 hours to obtain ground powder.

Step b: cellulose was added into water to prepare an aqueous solution of cellulose with a concentration of 1 wt %.

Step c: the ground powder obtained in step a was added into the aqueous solution obtained in step b according to a weight ratio 1:9 of cellulose to $TbF_3$ powder and mixed evenly to obtain mixed liquid.

Step d: mixed liquid obtained in step c in an amount equivalent to that of Embodiment 1.1, Embodiment 1.2, Embodiment 1.3, Embodiment 1.4, and Embodiment 1.5 was taken; the above-mentioned mixed liquid was uniformly and comprehensively spray-coated onto the above-mentioned magnet; the coated magnet was dried in an 80° C. environment; and diffusion heat treatment was performed for 30 hours at the temperature of 950° C. in a high-purity Ar gas atmosphere at 800 Pa-1000 Pa.

The magnet after diffusion was subjected to magnet performance testing by using the NIM-10000H large rare earth permanent magnet nondestructive testing system of the National Institute of Metrology, China. The determination temperature was 20° C.

Comparative Example 2

Cellulose and $TbF_3$ powder (with average grain size of 10 micrometers) were taken according to a weight ratio of 1:9 and were pressed to obtain a pressed block with a thickness of 0.6 mm. The magnet and the pressed block were stacked in the magnet orientation direction, and diffusion heat treatment was performed for 30 hours at the temperature of 950° C. in a high-purity Ar gas atmosphere at 800 Pa-1000 Pa.

The performance evaluation for magnets in Embodiments and Comparative Examples is shown in Table 2.

TABLE 2

Performance Evaluation for Magnets in Embodiments and Comparative Examples

| No. | Film thickness (mm) | Br (kGs) | Hcj (kOe) | (BH)max (MGOe) | SQ (%) | Hcj Standard Deviation |
|---|---|---|---|---|---|---|
| Embodiment 1.1 | 0.2 | 13.30 | 21.24 | 43.00 | 92.3 | 0.42 |
| Embodiment 1.2 | 0.4 | 13.31 | 23.29 | 42.98 | 91.9 | 0.35 |
| Embodiment 1.3 | 0.6 | 13.29 | 24.68 | 42.78 | 93.4 | 0.32 |
| Embodiment 1.4 | 0.8 | 13.20 | 25.50 | 42.26 | 92.3 | 0.28 |
| Embodiment 1.5 | 1 | 13.13 | 27.29 | 41.93 | 93.5 | 0.25 |
| Embodiment 1.6 | 1.2 | 13.06 | 27.68 | 41.38 | 94.4 | 0.34 |
| Comparative Example 1.1 | 0.2 | 13.29 | 20.73 | 42.75 | 92.8 | 1.12 |
| Comparative Example 1.2 | 0.4 | 13.04 | 21.30 | 41.33 | 93.1 | 1.03 |
| Comparative Example 1.3 | 0.6 | 12.87 | 22.42 | 40.65 | 89.5 | 0.84 |
| Comparative Example 1.4 | 0.8 | 12.78 | 23.83 | 39.82 | 90.7 | 0.78 |
| Comparative Example 1.5 | 1 | 12.56 | 24.29 | 38.36 | 81.2 | 0.62 |
| Comparative Example 2: | 0.6 | 12.84 | 20.11 | 40.11 | 93.9 | 1.33 |

Figure 2:
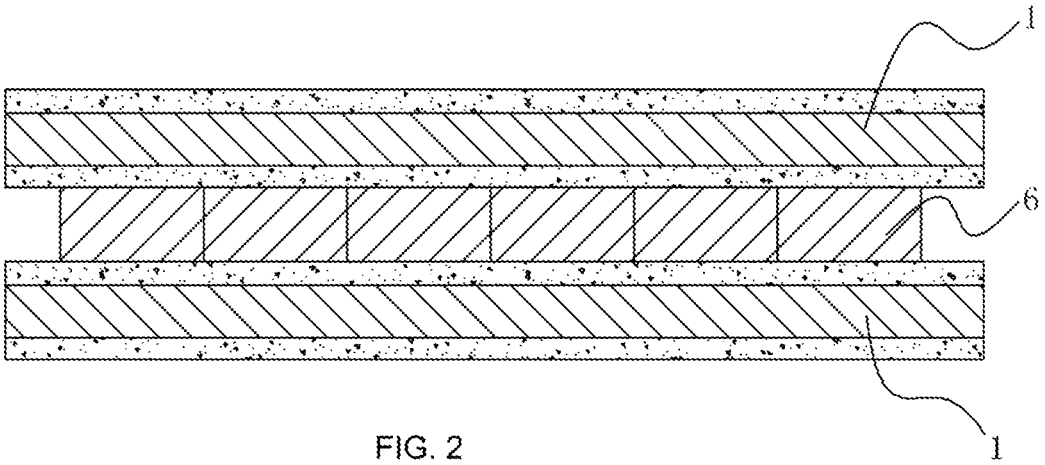
FIG. 2 is a schematic view of a diffusion process in Embodiment 1.

As illustrated in FIG. 2, the magnet 6 and the film covered W plate 1 were stacked in the magnet orientation direction, and diffusion heat treatment was performed for 30 hours at the temperature of 950° C. in a high-purity Ar gas atmosphere at 800 Pa-1000 Pa.

In the implementations of Embodiment 1.1, Embodiment 1.2, Embodiment 1.3, Embodiment 1.4, Embodiment 1.5, and Embodiment 1.6, spraying and drying of the mixed liquid were performed on the W plate. Therefore, in Embodiment 1.1, Embodiment 1.2, Embodiment 1.3, Embodiment 1.4, Embodiment 1.5, and Embodiment 1.6, oxidization and rusting on the surface of the magnet were not observed. In Comparative Example 1.1, Comparative Example 1.2, Comparative Example 1.3, Comparative Example 1.4, and Comparative Example 1.5, on the other hand, oxidization and rusting on the surface of the magnet were observed.

From Comparative Example 1.1 to Comparative Example 1.5 and Embodiment 1.1 to Embodiment 1.6, it can be seen that directly coating the mixed liquid onto the surface of the magnet leads to a decrease of residual magnetism (Br) and a lower increasing trend of the coercivity of the magnet. This is because, when the mixed liquid on the magnet surface is dried, the surface nature of the magnet changes, which greatly affects the diffusion effect. The change of the surface nature of the magnet may be due to the grain boundary corrosion caused by the wet heat environment during drying, or it may also be due to the decrease in diffusion efficiency because a film-forming agent fills a diffusion path of the magnet surface when the film-forming agent forms a film thereon.

In addition, in the implementations of Comparative Example 1.1 to Comparative Example 1.5, during the process of spraying the HRE diffusion source solution onto the rare earth sintered magnet, the magnet needs to be flipped. All six sides of the magnet contacting the HRE diffusion source results in a rapid decrease in Br in the diffusion process, which, at the same time, leads to the additional consumption of the HRE diffusion source on non-orientation sides. After the diffusion is done, an additional grinding process needs to be performed on the six sides.

In Comparative Example 2, the pressed block is constricted during the diffusion process. Thus, the diffusion effect of each magnet is very different.

Embodiment 2

Step a: $Dy_2O_3$ powder with an average grain size of 20 micrometers was taken; absolute ethyl alcohol was added therein until the $Dy_2O_3$ powder was immersed; and the mixture was placed in a ball mill for grinding for 25 h to obtain ground powder.

Step b: resin was added into the absolute ethyl alcohol to prepare an absolute ethyl alcohol solution of resin with a concentration of 20 wt %.

Step c: the ground powder obtained in step a was added into the absolute ethyl alcohol solution obtained in step b according to a weight ratio 0.07:1 of resin to $Dy_2O_3$ powder and mixed evenly to obtain mixed liquid.

Step d: a zirconia plate 21 with a length and width of 10 cm×10 cm and a thickness of 0.5 mm was taken and placed into an oven for heating until the temperature reached 120° C. and then was removed from the oven; the above-mentioned mixed liquid was uniformly sprayed onto the surface of the above-mentioned zirconia plate; and then the zirconia plate was placed into the oven again for drying to obtain a film covered zirconia plate, wherein the film 22 was adhered with $Dy_2O_3$ powder.

Figure 3:
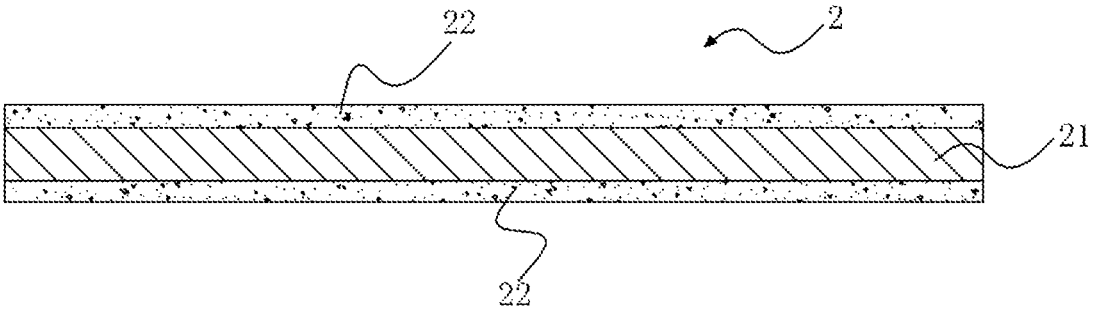
FIG. 3 is a structural schematic view of a film covered zirconia plate of Embodiment 2.

The operation of step d was repeated on the other side surface of the film covered zirconia plate to obtain a film covered zirconia plate 2 with the same film thickness at each side as illustrated in FIG. 3. The film thickness was 35 μm.

After the binding force test, the binding force between the film 22 and the zirconia plate 21 is found to be below Grade 4.

Embodiment 2.1-Embodiment 2.5

A rare earth magnet sintered body was prepared. The sintered body had the following atomic components: 13.6 of Nd, 1 of Co, 6.0 of B, 0.4 of Cu, 0.1 of Mn, 0.2 of Al, 0.1 of Bi, 0.3 of Ti, and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 15 mm×15 mm×5 mm, with the direction of 5 mm being the orientation direction of the magnetic field; and the processed magnet was subjected to sand blasting, purging, and surface cleaning. The magnet was subjected to magnet performance testing by using the NIM-10000H large rare earth permanent magnet nondestructive testing system of the National Institute of Metrology, China. The determination temperature was 20° C., and the determination results are as follows: Br: 14.43 kGs, Hcj: 16.27 kOe, (BH)max: 49.86 MGOe, SQ: 91.2%, and Hcj standard deviation value: 0.11.

As illustrated in FIG. 4.1, the magnet 7 and the film covered zirconia plate 2 were placed with different distances therebetween in the magnet orientation direction (for the distances, see Table 3); and diffusion heat treatment was performed for 12 hours at the temperature of 950° C. in a high-purity Ar gas atmosphere at 800 Pa-1000 Pa.

Comparative Example 2.1-Comparative Example 2.4

Comparative Example 2.1: as illustrated in FIG. 4.2, the magnet and the Dy plate 71 with a thickness of 1 mm were placed at a distance of 0.1 cm therebetween in the magnet orientation direction of the magnet 7; and diffusion heat treatment was performed for 24 hours at the temperature of 850° C. in a high-purity Ar gas atmosphere at 800 Pa-1000 Pa.

Comparative Example 2.2: as illustrated in FIG. 4.2, the magnet and the Dy plate 71 with a thickness of 1 mm were placed at a distance of 0.1 cm therebetween in the magnet orientation direction of the magnet 7; and diffusion heat treatment was performed for 12 hours at the temperature of 950° C. in a high-purity Ar gas atmosphere at 800 Pa-1000 Pa.

Comparative Example 2.3: as illustrated in FIG. 4.3, resin and $Dy_2O_3$ powder (with an average grain size of 20 micrometers) were taken according to a weight ratio of 0.07:1, and were pressed to obtain a pressed block with a thickness of 1 mm. The magnet 7 and the pressed block 72 were placed with a distance of 0.1 cm therebetween in the magnet orientation direction; and diffusion heat treatment was performed for 24 hours at the temperature of 850° C. in a high-purity Ar gas atmosphere at 800 Pa-1000 Pa.

Comparative Example 2.4: as illustrated in FIG. 4.3, resin and $Dy_2O_3$ powder (with an average grain size of 20 micrometers) were taken according to a weight ratio of 0.07:1, and were pressed to obtain a pressed block with a thickness of 1 mm. The magnet 7 and the pressed block 72 were placed with a distance of 0.1 cm therebetween in the magnet orientation direction; and diffusion heat treatment was performed for 12 hours at the temperature of 950° C. in a high-purity Ar gas atmosphere at 800 Pa-1000 Pa.

The magnet after diffusion was subjected to magnet performance testing by using the NIM-10000H large rare earth permanent magnet nondestructive testing system of the National Institute of Metrology, China. The determination temperature was 20° C.

The performance evaluation for magnets in Embodiments and Comparative Examples is shown in Table 3.

TABLE 3

Performance Evaluation for Magnets in Embodiments and Comparative Examples

| No. | Distance (cm) | Br (kGs) | Hcj (kOe) | (BH)max (MGOe) | SQ (%) | Hcj Standard Deviation |
|---|---|---|---|---|---|---|
| Embodiment 2.1 | 0.1 | 14.02 | 24.81 | 47.78 | 92.7 | 0.36 |
| Embodiment 2.2 | 0.5 | 14.11 | 23.58 | 48.30 | 93.3 | 0.52 |
| Embodiment 2.3 | 0.7 | 14.13 | 22.56 | 48.43 | 92.2 | 0.82 |
| Embodiment 2.4 | 1 | 14.26 | 21.45 | 49.35 | 92.1 | 1.13 |
| Embodiment 2.5 | 1.5 | 14.39 | 20.29 | 49.98 | 93.0 | 1.45 |
| Comparative Example 2.1 | 0.1 | 14.37 | 19.08 | 50.10 | 93.6 | 0.84 |
| Comparative Example 2.2 | 0.1 | 14.33 | 20.24 | 49.92 | 93.6 | 0.76 |
| Comparative Example 2.3 | 0.1 | 14.23 | 18.69 | 48.85 | 94.2 | 1.24 |
| Comparative Example 2.4 | 0.1 | 14.18 | 19.71 | 48.65 | 93.7 | 1.23 |

In the implementations of Embodiment 2.1, Embodiment 2.2, Embodiment 2.3, Embodiment 2.4, and Embodiment 2.5, spraying and drying of the mixed liquid were performed on the zirconia plate. Therefore, in Embodiment 2.1, Embodiment 2.2, Embodiment 2.3, Embodiment 2.4, and Embodiment 2.5, oxidization and rusting on the surface of the magnet were not observed.

From the Comparative Examples and the Embodiments, it can be seen that the diffusion efficiency in Embodiment 2.1, Embodiment 2.2, Embodiment 2.3, Embodiment 2.4, and Embodiment 2.5 decreases with the increases of the distance. When the distance is below 1 cm, the influence on the diffusion efficiency is small. In Comparative Example 2.3 and Comparative Example 2.4, the pressed block 72 is constricted in the diffusion process; thus, the diffusion effect of each magnet is very different.

Different from the known method of diffusion through direct contact with HRE compound powder, the diffusion is done by using the HRE vapor process (not in direct contact) in Embodiment 2, and good diffusion effects are also achieved.

Embodiment 3

Step a: groups of $TbF_3$ powder with different average grain sizes were taken (as illustrated in FIG. 4); absolute ethyl alcohol was added therein until the $TbF_3$ powder was immersed; and the mixture was placed in a ball mill for grinding for 5 hours to obtain ground powder.

Step b: dry oil was added into the absolute ethyl alcohol to prepare an absolute ethyl alcohol solution of dry oil with a concentration of 1 wt %.

Step c: the ground powder obtained in step a was added into the absolute ethyl alcohol solution obtained in step b according to a weight ratio 0.05:1 of dry oil to $TbF_3$ powder and mixed evenly to obtain mixed liquid.

Step d: a Mo plate 31 with a length and width of 10 cm×10 cm and a thickness of 0.5 mm was taken and placed into an oven until the temperature reached 100° C. and then was removed from the oven; the above-mentioned mixed liquid was uniformly sprayed onto the surface of one side of the above-mentioned Mo plate; and then the Mo plate was put into the oven again for drying to obtain a film covered Mo plate, wherein the film 32 was adhered with $TbF_3$ powder.

The operation of step d was repeated on the other side surface of the film covered Mo plate to obtain a film covered Mo plate 3 with the same film thickness at each side as illustrated in FIG. 5. The film thickness was 100 μm.

After the binding force test, the binding force between the film (the average grain size of the $TbF_3$ powder is as shown in Table 4) and the Mo plate is found to be below Grade 4.

Embodiment 3.1-Embodiment 3.5

A rare earth magnet sintered body was prepared. The sintered body had the following atomic components: 0.1 of Ho, 13.8 of Nd, 1 of Co, 6.0 of B, 0.4 of Cu, 0.1 of Al, 0.2 of Ga, and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 15 mm×15 mm×10 mm, with the direction of 10 mm being the orientation direction of the magnetic field; and the processed magnet was subjected to sand blasting, purging, and surface cleaning. The magnet was subjected to magnet performance testing by using the NIM-10000H large rare earth permanent magnet nondestructive testing system of the National Institute of Metrology, China. The determination temperature was 20° C., and the determination results are as follows: Br: 14.39 kGs, Hcj: 18.36 kOe, (BH)max: 50.00 MGOe, SQ: 92.9%, and Hcj standard deviation value: 0.13.

As illustrated in FIG. 6, the magnet 8 and the film covered Mo plate 3 (the average grain size of $TbF_3$ powder is as shown in Table 4) were stacked in the magnet orientation direction; and diffusion heat treatment was performed for 12 hours at the temperature of 1000° C. in a high-purity Ar gas atmosphere at 1800 Pa-2000 Pa.

Comparative Example 3.1-Comparative Example 3.4

Comparative Example 3.1: a magnet was embedded in $TbF_3$ powder (with average grain size of 50 micrometers), and diffusion heat treatment was performed for 24 hours at the temperature of 950° C. in a high-purity Ar gas atmosphere at 1800 Pa-2000 Pa.

Comparative Example 3.2: a magnet was embedded in $TbF_3$ powder (with average grain size of 50 micrometers), and diffusion heat treatment was performed for 12 hours at the temperature of 1000° C. in a high-purity Ar gas atmosphere at 1800 Pa-2000 Pa.

Comparative Example 3.3: a Tb film was electro-deposited on the above-mentioned magnet (the thickness of Tb electroplating layer: 100 μm); and diffusion heat treatment was performed for 24 hours at the temperature of 950° C. in a high-purity Ar gas atmosphere at 1800 Pa-2000 Pa.

Comparative Example 3.4: a Tb film was electro-deposited on the above-mentioned magnet (the thickness of Tb electroplating layer: 100 μm); and diffusion heat treatment was performed for 12 hours at the temperature of 1000° C. in a high-purity Ar gas atmosphere at 1800 Pa-2000 Pa.

The magnet after diffusion was subjected to magnet performance testing by using the NIM-10000H large rare earth permanent magnet nondestructive testing system of the National Institute of Metrology, China. The determination temperature was 20° C.

The performance evaluation for magnets in Embodiments and Comparative Examples is shown in Table 4.

TABLE 4

Performance Evaluation for Magnets in Embodiments and Comparative Examples

| No. | $TbF_3$ powder average grain size (μm) | Br (kGs) | Hcj (kOe) | (BH)max (MGOe) | SQ (%) | Hcj Standard Deviation |
|---|---|---|---|---|---|---|
| Embodiment 3.1 | 20 | 14.37 | 30.12 | 49.96 | 92.4 | 0.28 |
| Embodiment 3.2 | 50 | 14.34 | 27.97 | 50.30 | 94.4 | 0.55 |
| Embodiment 3.3 | 100 | 14.37 | 25.38 | 50.09 | 93.8 | 0.72 |
| Embodiment 3.4 | 200 | 14.34 | 23.13 | 50.04 | 93.1 | 0.84 |
| Embodiment 3.5 | 300 | 14.37 | 19.90 | 50.12 | 90.5 | 1.33 |
| Comparative Example 3.1 | 50 | 14.16 | 23.50 | 48.80 | 91.7 | 1.12 |
| Comparative Example 3.2 | 50 | 14.02 | 24.32 | 46.80 | 88.9 | 1.06 |
| Comparative Example 3.3 | / | 14.04 | 23.42 | 47.35 | 88.7 | 0.82 |
| Comparative Example 3.4 | / | 14.03 | 24.10 | 47.29 | 87.5 | 0.74 |

In the implementations of Embodiment 3.1, Embodiment 3.2, Embodiment 3.3, Embodiment 3.4, and Embodiment 3.5, spraying and drying of the mixed liquid were performed on the zirconia plate; and therefore, in Embodiment 3.1, Embodiment 3.2, Embodiment 3.3, Embodiment 3.4, and Embodiment 3.5, oxidization and rusting on the surface of the magnet were not observed.

From the Comparative Examples and Embodiments, it can be seen that the diffusion effects in Embodiment 3.1, Embodiment 3.2, Embodiment 3.3, Embodiment 3.4, and Embodiment 3.5 are better; Br of the magnet is neglibly decreased; the coercivity is improved significantly and the diffusion effect of each magnet is uniform. In Comparative Example 3.1 and Comparative Example 3.2, the $TbF_3$ powder is not uniformly aggregated in the diffusion process; thus, the diffusion effect of each magnet is very different.

Embodiment 4

Step a: $TbCl_3$ powder with an average grain size of 50 micrometers was taken and added therein with absolute ethyl alcohol to prepare $TbCl_3$ solution.

Step b: fluorosilicone was added into water to prepare an aqueous solution of fluorosilicone with a concentration of 10 wt %.

Step c: the solution obtained in step a was added into the aqueous solution obtained in step b according to a weight ratio 0.02:1 of fluorosilicone to $TbCl_3$ and mixed evenly to obtain mixed liquid.

Step d: a W plate 41 with a length and width of 9 cm×9 cm and a thickness of 0.5 mm was taken and placed into an oven for heating until the temperature reached 80° C. and then was removed from the oven; the W plate 41 was respectively covered with an equally wide obstacle at a distance of 2 cm; the width of the obstacle was as shown in Table 5; the above-mentioned mixed liquid was uniformly sprayed onto the surface of the above-mentioned W plate; and then the W plate was placed into the oven again for drying to strip the obstacle to obtain a film covered W plate with a film 42, wherein the film thickness was 0.5 mm. The film was adhered with $TbCl_3$ powder.

Figure 7:
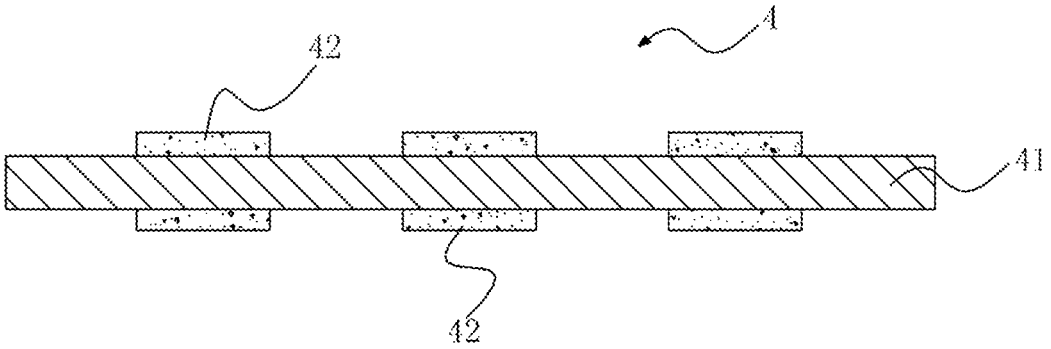
FIG. 7 is a structural schematic view of a film covered W plate of embodiment 4.

The operation of step d was repeated on the other side surface of the film covered W plate to obtain a film covered W plate 4 with the same film thickness on each side, as illustrated in FIG. 7.

Embodiment 4.1-Embodiment 4.5

A rare earth magnet sintered body was prepared. The sintered body had the following atomic components: 0.1 of Pr, 13.7 of Nd, 1 of Co, 6.5 of B, 0.4 of Cu, 0.1 of Al, 0.1 of Ga, 0.3 of Ti, and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 10 mm×10 mm×20 mm, with the direction of 20 mm being the orientation direction of the magnetic field; and the processed magnet was subjected to sand blasting, purging, and surface cleaning. The magnet was subjected to magnet performance testing by using the NIM-10000H large rare earth permanent magnet nondestructive testing system of the National Institute of Metrology, China. The determination temperature was 20° C., and the determination results are as follows: Br: 14.30 kGs, Hcj: 17.07 kOe, (BH)max: 49.20 MGOe, SQ: 92.2%, and Hcj standard deviation value: 0.22.

Figure 8:
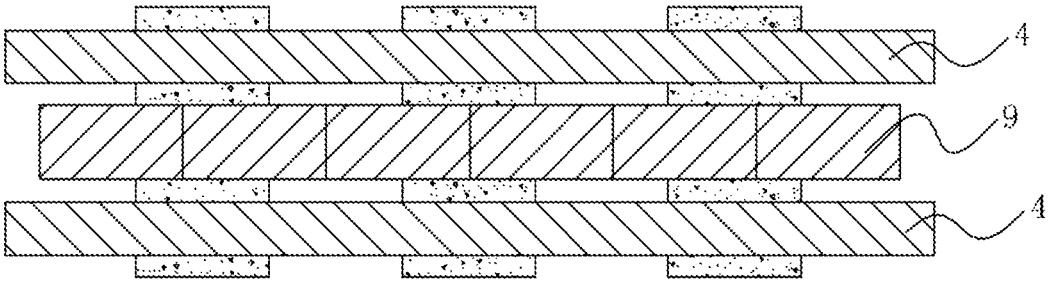
FIG. 8 is a schematic view of a diffusion process in Embodiment 4.

As illustrated in FIG. 8, the magnet 9 and the film covered W plate 4 were stacked in the magnet orientation direction, and diffusion heat treatment was performed for 6 hours at the temperature of 1020° C. in a high-purity Ar gas atmosphere at 0.05 MPa.

The magnet after diffusion was subjected to magnet performance testing by using the NIM-10000H large rare earth permanent magnet nondestructive testing system of the National Institute of Metrology, China. The determination temperature was 20° C.

The performance evaluation for magnets in Embodiments is shown in Table 5.

TABLE 5

Performance Evaluation for Magnets in Embodiments

| No. | Obstacle width (cm) | Br (kGs) | Hcj (kOe) | (BH)max (MGOe) | SQ (%) | Hcj Standard Deviation |
|---|---|---|---|---|---|---|
| Embodiment 4.1 | 0.1 | 14.27 | 28.07 | 49.62 | 94.0 | 0.32 |
| Embodiment 4.2 | 0.5 | 14.30 | 26.16 | 49.26 | 93.9 | 0.43 |
| Embodiment 4.3 | 1 | 14.30 | 24.07 | 49.75 | 94.4 | 0.54 |
| Embodiment 4.4 | 1.5 | 14.34 | 22.71 | 49.75 | 95.4 | 0.72 |
| Embodiment 4.5 | 2 | 14.32 | 19.90 | 49.82 | 93.9 | 1.13 |

It can be seen from the examples that in a step-by-step film forming diffusion mode, when the distance between the films at the two ends is below 1.5 cm, the uniformity of the diffusion effect is not affected, which is possibly because the diffusion speed is not greatly influenced when the diffusion distance fluctuates within the range of about 1.5 cm.

Embodiment 5

Step a: $Tb(NO_3)_3$ powder with an average grain size of 80 micrometers was taken and added therein with water to prepare $Tb(NO_3)_3$ solution.

Step b: water glass was added into water to prepare an aqueous solution of water glass with a concentration of 1 wt %.

Step c: the solution obtained in step a was added into the aqueous solution obtained in step b according to a weight ratio 0.01:0.9 of water glass to $Tb(NO_3)_3$ powder and mixed evenly to obtain mixed liquid.

Figure 9:
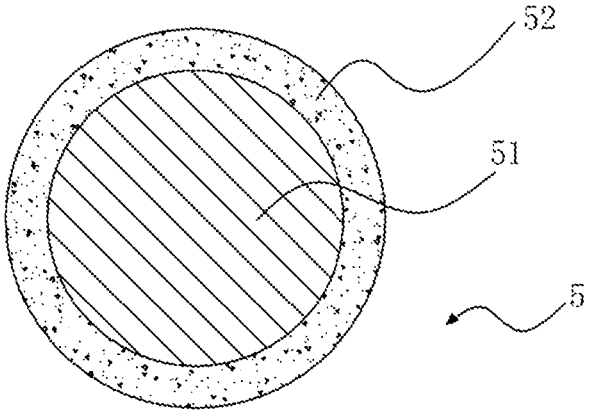
FIG. 9 is a structural schematic view of a film covered W round ball of Embodiment 5.

Step d: a W round ball 51 with a diameter of 0.1 mm-3 mm (with the diameter of the W round ball shown in Table 6) was taken and placed in an oven for heating until the temperature reached 80° C., and then was removed from the oven; the above-mentioned mixed liquid was uniformly sprayed onto the surface of the above-mentioned W round ball; and the W round ball was placed in the oven again to obtain a film covered W round ball 5, as illustrated in FIG. 9. The thickness of the film 52 is 0.15 mm and the film is adhered with $Tb(NO_3)_3$.

Embodiment 5.1-Embodiment 5.5

A rare earth magnet sintered body was prepared. The sintered body had the following atomic components: 0.1 of Ho, 13.8 of Nd, 1 of Co, 6.0 of B, 0.4 of Cu, 0.1 of Mn, 0.2 of Ga, and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 10 mm×10 mm×12 mm, with the direction of 12 mm being the orientation direction of the magnetic field; and the processed magnet was subjected to sand blasting, purging, and surface cleaning. The magnet 10 was subjected to magnet performance testing by using the NIM-10000H large rare earth permanent magnet nondestructive testing system of the National Institute of Metrology, China. The determination temperature was 20° C., and the determination results are as follows: Br: 14.39 kGs, Hcj: 18.36 kOe, (BH)max: 50.00 MGOe, SQ: 92.9%, and Hcj standard deviation value: 0.13.

Figure 10:
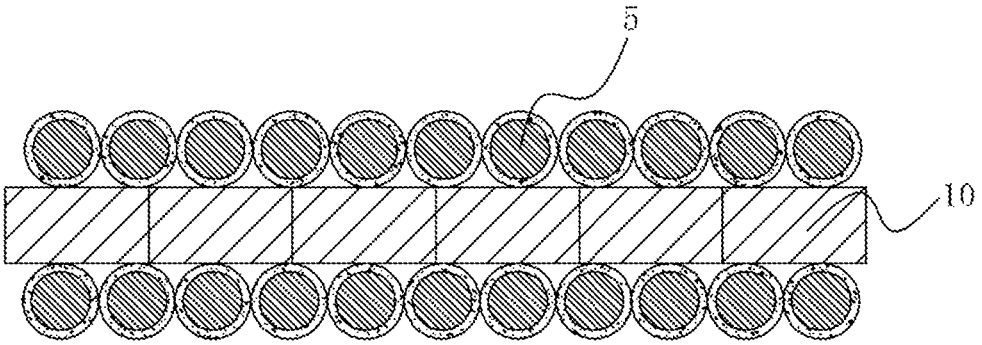
FIG. 10 is a schematic view of a diffusion process in Embodiment 5.

As illustrated in FIG. 10, the film covered W round balls 5 are densely arranged and placed on the surface of the magnet 10 in the orientation direction; and diffusion heat treatment was performed for 100 hours at the temperature of 800° C. in a high-purity Ar gas atmosphere at 2800 Pa-3000 Pa.

The performance evaluation for magnets in Embodiments and Comparative Examples is shown in Table 6.

TABLE 6

Performance Evaluation for Magnets in Embodiments and Comparative Examples

| No. | W round ball diameter (mm) | Br (kGs) | Hcj (kOe) | (BH)max (MGOe) | SQ (%) | Hcj Standard Deviation |
|---|---|---|---|---|---|---|
| Embodiment 5.1 | 0.1 | 14.29 | 28.29 | 49.46 | 92.9 | 0.25 |
| Embodiment 5.2 | 0.5 | 14.32 | 27.74 | 49.59 | 94.2 | 0.46 |
| Embodiment 5.3 | 1 | 14.32 | 25.47 | 49.77 | 93.7 | 0.62 |
| Embodiment 5.4 | 2 | 14.31 | 24.72 | 49.69 | 93.4 | 0.74 |
| Embodiment 5.5 | 3 | 14.34 | 23.13 | 50.04 | 93.1 | 1.09 |

Embodiment 6

Step a: different powder with an average grain size of 10 μm was taken (with powder types shown in Table 7); absolute ethyl alcohol was added therein until the $TbF_3$ powder was immersed; and the mixture was placed in a ball mill for grinding for 5 h to obtain ground powder.

Step b: cellulose was added into absolute ethyl alcohol to prepare an absolute ethyl alcohol solution of cellulose with a concentration of 1 wt %.

Step c: the ground powder obtained in step a was added into the absolute ethyl alcohol solution obtained in step b according to a weight ratio 0.05:1 of cellulose to $TbF_3$ powder and mixed evenly to obtain mixed liquid.

Step d: a Mo plate 61 with a length and width of 10 cm×10 cm and a thickness of 0.5 mm was taken and placed into an oven for heating until the temperature reached 100° C. and then was removed from the oven; the above-mentioned mixed liquid was uniformly sprayed onto the surface of one side of the above-mentioned Mo plate; and then the Mo plate was put into the oven again for drying to obtain a film covered Mo plate, wherein the film 62 was adhered with $TbF_3$ powder.

Figure 11:
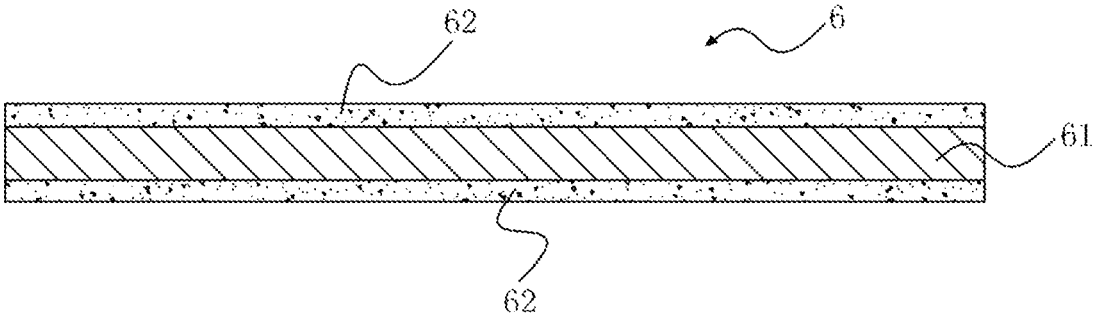
FIG. 11 is a structural schematic view of a film covered Mo plate of Embodiment 6.

The operation of step d was repeated on the other side surface of the film covered Mo plate to obtain a film covered Mo plate 6 with the same film thickness at each side as illustrated in FIG. 11. The film thickness was 30 μm.

After the binding force test, the binding force between the film and the Mo plate is found to be below 4.

Embodiment 6.1-Embodiment 6.4:

A rare earth magnet sintered body was prepared. The sintered body had the following atomic components: 0.1 of Ho, 13.8 of Nd, 1 of Co, 6.0 of B, 0.4 of Cu, 0.1 of Al, 0.2 of Ga, and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 15 mm×15 mm×5 mm, with the direction of 5 mm being the orientation direction of the magnetic field; and the processed magnet was subjected to sand blasting, purging, and surface cleaning. The magnet was subjected to magnet performance testing by using the NIM-10000H large rare earth permanent magnet nondestructive testing system of the National Institute of Metrology, China. The determination temperature was 20° C., and the determination results are as follows: Br: 14.39 kGs, Hcj: 18.36 kOe, (BH)max: 50.00 MGOe, SQ: 92.9%, and Hcj standard deviation value: 0.13.

Figure 12:
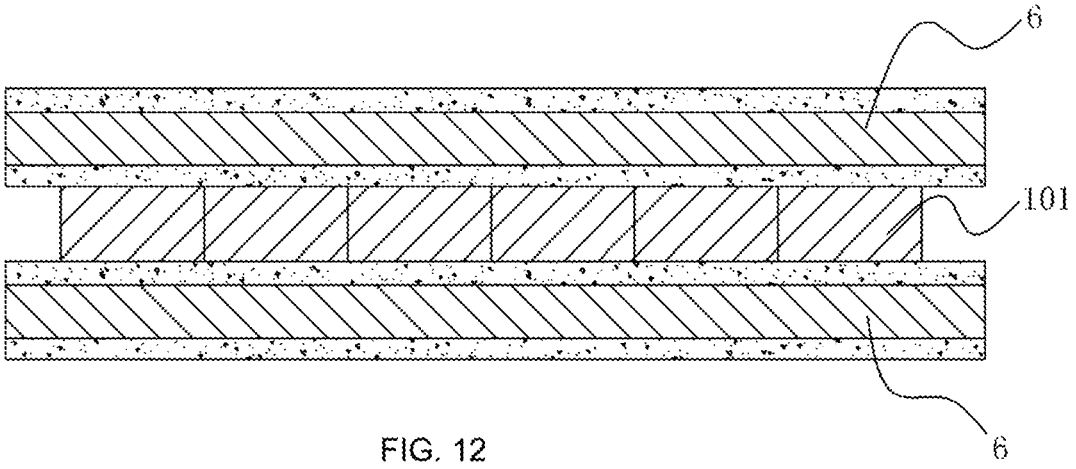
FIG. 12 is a schematic view of a diffusion process in Embodiment 6.

As illustrated in FIG. 12, the magnet 101 and the film covered Mo plate 6 were stacked in the magnet orientation direction, and diffusion heat treatment was performed for 12 hours at the temperature of 950° C. in a high-purity Ar gas atmosphere at 1800 Pa-2000 Pa.

The magnet after diffusion was subjected to magnet performance testing by using the NIM-10000H large rare earth permanent magnet nondestructive testing system of the National Institute of Metrology, China. The determination temperature was 20° C.

The performance evaluation for magnets in Embodiments and Comparative Examples is shown in Table 7.

TABLE 7

Performance Evaluation for Magnets in Embodiments

| No. | Powder type | Br (kGs) | Hcj (kOe) | (BH)max (MGOe) | SQ (%) | Hcj Standard Deviation |
|---|---|---|---|---|---|---|
| Embodiment 6.1 | $TbF_3$ powder | 14.24 | 29.97 | 49.43 | 92.3 | 0.24 |
| Embodiment 6.2 | $TbF_3$:$Tb_2O_3$ = 1:1 | 14.29 | 21.47 | 49.31 | 89.5 | 0.84 |
| Embodiment 6.3 | $TbF_3$:TbCu = 1:1 | 14.26 | 26.57 | 49.40 | 91.0 | 0.62 |
| Embodiment 6.4 | $TbF_3$:$Al_2O_3$ = 1:1 | 14.27 | 22.61 | 49.01 | 92.9 | 0.78 |

As can be seen from the Embodiments, different types of powder are used in Embodiment 6.1, Embodiment 6.2, Embodiment 6.3, and Embodiment 6.4. The mixed powder easily lead to other reactions and the diffusion effects are relatively poor.

Embodiment 7

Step a: $TbF_3$ powder with an average grain size of 20 micrometers was taken; absolute ethyl alcohol was added therein until the $TbF_3$ powder was immersed; and grinding was performed for 20 h to obtain ground powder.

Step b: resin was added into the absolute ethyl alcohol to prepare an absolute ethyl alcohol solution of resin with a concentration of 20 wt %.

Step c: the ground powder obtained in step a was added into the absolute ethyl alcohol solution obtained in step b according to a weight ratio 0.07:1 of resin to $TbF_3$ powder and mixed evenly to obtain mixed liquid.

Step d: a zirconia plate 21 with a length and width of 10 cm×10 cm and a thickness of 0.5 mm was taken and placed into an oven for heating until the temperature reached 120° C. and then was removed from the oven; the above-mentioned mixed liquid was uniformly sprayed onto the surface of the above-mentioned zirconia plate; and then the zirconia plate was placed into the oven again for drying to obtain a film covered zirconia plate, wherein the film 22 was adhered with $TbF_3$ powder.

The operation of step d was repeated on the other side surface of the film covered zirconia plate to obtain a film covered zirconia plate with the same film thickness at each side, and the film thickness was 30 μm.

After the binding force test, the binding force between the film and the zirconia plate is found to be below Grade 4.

Embodiment 7.1-Embodiment 7.5

A rare earth magnet sintered body was prepared. The sintered body had the following atomic components: 13.6 of Nd, 1 of Co, 6.0 of B, 0.4 of Cu, 0.05 of Mn, 0.3 of Al, 0.1 of Bi, 0.3 of Ti, and balance of Fe. Preparation was performed according to the existing processes of smelting, casting, hydrogen decrepitation, jet milling, pressing, sintering, and heat treatment of rare earth magnets.

The sintered body obtained after the heat treatment was processed into a magnet with a size of 15 mm×15 mm×5 mm, with the direction of 5 mm being the orientation direction of the magnetic field; and the processed magnet was subjected to sand blasting, purging, and surface cleaning. The magnet was subjected to magnet performance testing by using the NIM-10000H large rare earth permanent magnet nondestructive testing system of the National Institute of Metrology, China. The determination temperature was 20° C., and the determination results are as follows: Br: 14.33 kGs, Hcj: 15.64 kOe, (BH)max: 49.25 MGOe, SQ: 89.8%, and Hcj standard deviation value: 0.11.

The film covered zirconia plate, a molybdenum net with a thickness of 0.5 mm, the magnet, and a molybdenum net with a thickness of 0.5 mm were sequentially stacked in the magnet orientation direction (distances therebetween are shown in Table 8); and diffusion heat treatment was performed for 12 hours at the temperature of 950° C. in a high-purity Ar gas atmosphere at $10^{-3}$ Pa-1000 Pa.

TABLE 8

Performance Evaluation for Magnets in Embodiments

| No. | Atmospheric pressure (Pa) | Br (kGs) | Hcj (kOe) | (BH)max (MGOe) | SQ (%) | Hcj Standard Deviation |
|---|---|---|---|---|---|---|
| Embodiment 7.1 | $10^{-3}$ | 14.35 | 28.35 | 49.47 | 84.1 | 0.36 |
| Embodiment 7.2 | $10^{-1}$ | 14.28 | 27.62 | 49.16 | 87.3 | 0.52 |
| Embodiment 7.3 | 10 | 14.32 | 26.23 | 49.65 | 86.7 | 0.82 |
| Embodiment 7.4 | 100 | 14.33 | 25.20 | 49.37 | 86.7 | 1.13 |
| Comparative Example 7.1 | 1000 | 14.36 | 24.08 | 49.88 | 89.0 | 1.52 |

The embodiments described above only serve to further illustrate some particular implementations of the present disclosure; however, the present invention is not limited to these embodiments. Any simple alternations, equivalent changes, and modifications made to the embodiments above according to the technical essence of the present invention shall fall within the protection scope of the technical solutions of the present invention.

The invention claimed is:

1. A grain boundary diffusion method of an R—Fe—B series rare earth sintered magnet, wherein the grain boundary diffusion method comprises:

forming at least two spaced apart dry layers on a same surface of a high-temperature-resistant carrier to yield a treated high-temperature-resistant carrier, wherein:

the at least two dry layers are adhered with heavy rare earth elements (HRE) compound powder, every two adjacent dry layers the at least two dry layers are uniformly distributed on the high-temperature-resistant carrier at a spacing of below 1.5 cm, the HRE is at least one of Dy, Tb, Gd, or Ho, the at least two dry layers adhered with the HRE compound powder comprise a film-forming agent and the HRE compound powder, and a weight ratio of the film-forming agent to the HRE compound powder is (0.01-0.1):0.9; and performing heat treatment on the R—Fe—B series rare earth sintered magnet and the treated high-temperature-resistant carrier in a vacuum or inert atmosphere and supplying the HRE to a surface of the R—Fe–B series rare earth sintered magnet, wherein, while performing the heat treatment, the at least two dry layers adhered with the HRE compound powder formed on the high-temperature-resistant carrier and the R—Fe—B series rare earth sintered magnet are placed in a non-contact manner.

2. The grain boundary diffusion method of the R—Fe—B series rare earth sintered magnet according to claim 1, wherein atmospheric pressure of a treatment chamber in which the heat treatment is performed is below 0.05 MPa.

3. The grain boundary diffusion method of the R—Fe—B series rare earth sintered magnet according to claim 1, wherein:

when the at least two dry layers adhered with the HRE compound powder and the R—Fe—B series rare earth sintered magnet are placed in the non-contact manner, an average spacing therebetween is set to be below 1 cm.

4. The grain boundary diffusion method of the R—Fe—B series rare earth sintered magnet according to claim 1, wherein, when the at least two dry layers adhered with the HRE compound powder and R—Fe—B series rare earth sintered magnet are placed in the non-contact manner, atmospheric pressure of a treatment chamber in which the heat treatment is performed is below 1000 Pa.

5. The grain boundary diffusion method of the R—Fe—B series rare earth sintered magnet according to claim 1, wherein, when the at least two dry layers adhered with the HRE compound powder and R—Fe—B series rare earth sintered magnet are placed in the non-contact manner, atmospheric pressure of a treatment chamber in which the heat treatment is performed is below 100 Pa.

6. The grain boundary diffusion method of the R—Fe—B series rare earth sintered magnet according to claim 1, wherein the at least two dry layers are films.

7. The grain boundary diffusion method of the R—Fe—B series rare earth sintered magnet according to claim 1, wherein a heat treatment temperature of the heat treatment is a temperature below a sintering temperature of the R—Fe—B series rare earth sintered magnet.

8. The grain boundary diffusion method of the R—Fe—B series rare earth sintered magnet according to claim 7, wherein while performing the heat treatment, the R—Fe—B series rare earth sintered magnet and the treated high-temperature-resistant carrier are heated for 5-100 hours in an environment of 800° C.–1020° C.

9. The grain boundary diffusion method of the R—Fe—B series rare earth sintered magnet according to claim 1, wherein a thickness of the at least two dry layers is below 1 mm.

10. The grain boundary diffusion method of the R—Fe—B series rare earth sintered magnet according to claim 1, wherein the R—Fe—B series rare earth sintered magnet extends continuously from a first position overlapping a first of the at least two dry layers to a second position overlapping a second of the at least two dry layers.

11. The grain boundary diffusion method of the R—Fe—B series rare earth sintered magnet according to claim 1, wherein a binding force between each of the at least two dry layers and the high-temperature-resistant carrier is level 0, level 1, level 2, level 3, or level 4.

12. The grain boundary diffusion method of the R—Fe—B series rare earth sintered magnet according to claim 1, wherein:

the film-forming agent is capable of being removed for at least 95 wt % while performing the heat treatment, and the film-forming agent is at least one of resins, cellulose, fluorosilicone polymers, dry oil, or water glass.

13. The grain boundary diffusion method of the R—Fe—B series rare earth sintered magnet according to claim 1, wherein:

the high-temperature-resistant carrier is a high-temperature-resistant net, a high-temperature-resistant plate, or a high-temperature-resistant strip, and the high-temperature-resistant carrier is made of a material selected from zirconia, alumina, yttrium oxide, boron nitride, silicon nitride, and silicon carbide, and a metal selected from Mo, W, Nb, Ta, Ti, Hf, Zr, V, Re of group IVB, VB, VIB, and VIIB in Periodic Table, or made of an alloy of the above materials.

14. The grain boundary diffusion method of the R—Fe–B series rare earth sintered magnet according to claim 1, wherein:

the HRE compound powder is powder of at least one of HRE oxide, HRE fluoride, HRE chloride, HRE nitrate, or HRE oxyfluoride, and an average particle size of the powder is below 200 micrometers.

15. The grain boundary diffusion method of the R—Fe—B series rare earth sintered magnet according to claim 14, wherein in the at least two dry layers adhered with the HRE compound powder, the content of HRE oxide, HRE fluoride, HRE chloride, HRE nitrate, and HRE oxyfluoride is above 90 wt %.

16. The grain boundary diffusion method of the R—Fe—B series rare earth sintered magnet according to claim 1, wherein a thickness of the R—Fe—B series rare earth sintered magnet along a magnetic orientation direction thereof is below 30 mm.

17. The grain boundary diffusion method of the R—Fe—B series rare earth sintered magnet according to claim 1, wherein:

the R—Fe—B series rare earth sintered magnet takes $R_2Fe_{14}B$ crystallized grains as a main phase, R comprises at least one rare earth element, an amount of Nd and/or Pr is above 50 wt % of an amount of R, and components of the R—Fe—B series rare earth sintered magnet comprise M, and M is at least one of Co, Bi, Al, Ca, Mg, O, C, N, Cu, Zn, In, Si, S, P, Ti, V, Cr, Mn, Ni, Ga, Ge, Zr, Nb, Mo, Pd, Ag, Cd, Sn, Sb, Hf, Ta, or W.

18. The grain boundary diffusion method of the R—Fe–B series rare earth sintered magnet according to claim 1, wherein an average particle size of the HRE compound powder is below 200 micrometers.

* * * * *